US011143018B2

(12) United States Patent
Levchak et al.

(10) Patent No.: US 11,143,018 B2
(45) Date of Patent: Oct. 12, 2021

(54) ENVIRONMENTAL COMPENSATION SYSTEM FOR DOWNHOLE OILWELL TOOLS

(71) Applicant: Halliburton Energy Services, Inc., Houston, TX (US)

(72) Inventors: Michael John Levchak, Tomball, TX (US); Stephen L. Woolverton, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/641,202

(22) PCT Filed: Oct. 16, 2017

(86) PCT No.: PCT/US2017/056734
§ 371 (c)(1),
(2) Date: Feb. 21, 2020

(87) PCT Pub. No.: WO2019/078810
PCT Pub. Date: Apr. 25, 2019

(65) Prior Publication Data
US 2021/0095556 A1 Apr. 1, 2021

(51) Int. Cl.
*E21B 47/017* (2012.01)
*E21B 47/06* (2012.01)

(52) U.S. Cl.
CPC ..... *E21B 47/017* (2020.05); *E21B 47/06* (2013.01)

(58) Field of Classification Search
CPC ..... E21B 47/017; E21B 47/06
See application file for complete search history.

(56) References Cited

U.S. PATENT DOCUMENTS

| | | | | |
|---|---|---|---|---|
| 4,335,791 | A | 6/1982 | Evans | |
| 6,268,672 | B1 | 7/2001 | Straub et al. | |
| 10,027,013 | B2 | 7/2018 | Korovin et al. | |
| 10,167,715 | B2 | 1/2019 | Rashid et al. | |
| 2002/0174981 | A1 | 11/2002 | Den Boer et al. | |
| 2005/0218898 | A1* | 10/2005 | Fredette | G01V 3/30 324/342 |
| 2009/0071645 | A1 | 3/2009 | Kenison et al. | |
| 2009/0301780 | A1 | 12/2009 | Gearhart et al. | |

(Continued)

FOREIGN PATENT DOCUMENTS

EP 1165934 9/2004

OTHER PUBLICATIONS

ISRWO International Search Report and Written Opinion for PCT/US2017/056734 dated Feb. 28, 2018.

*Primary Examiner* — Brad Harcourt
(74) *Attorney, Agent, or Firm* — Benjamin Ford; C. Tumey Law Group PLLC

(57) ABSTRACT

This disclosure may generally relate to systems and methods to compensate for changes in environmental conditions, such as temperature and pressure, that may be experienced by downhole tools. A downhole tool may include a tool body; a protective sleeve disposed around the tool body, wherein an annulus is formed between the protective sleeve and the tool body; a sensor coupled to the tool body; and an environmental compensation system, wherein the environmental compensation system comprises a bladder, and wherein an interior of the bladder is in fluid communication with the annulus.

17 Claims, 6 Drawing Sheets

(56) References Cited

U.S. PATENT DOCUMENTS

| | | | | |
|---|---|---|---|---|
| 2011/0277545 | A1* | 11/2011 | Ratcliffe | E21B 47/017 73/152.51 |
| 2015/0277452 | A1 | 10/2015 | Kristensen | |
| 2015/0300841 | A1* | 10/2015 | Campbell | G01B 7/14 417/410.1 |
| 2016/0053582 | A1* | 2/2016 | Payne | E21B 47/017 166/377 |
| 2017/0241257 | A1* | 8/2017 | Li | E21B 47/017 |
| 2018/0335323 | A1* | 11/2018 | Lu | E21B 33/0385 |

* cited by examiner

ENVIRONMENTAL COMPENSATION SYSTEM FOR DOWNHOLE OILWELL TOOLS

BACKGROUND

Wells are drilled into subterranean formations to recover valuable hydrocarbons. Various operations may be performed before, during, and after the well has been drilled to produce and continue the flow of the hydrocarbon fluids to the surface. During exploration and production, measurements are often taken to monitor downhole conditions (e.g., temperature and pressure) and to measure the surrounding formation for fluid, hydrocarbon, and rock properties. Logging-while-drilling (LWD) and measurement-while-drilling (MWD) tools employ numerous sensors to acquire this data.

Often, the sensors within LWD/MWD tools need protection from the relatively harsh subterranean environments. Sensors may, for example, be enclosed within an outer, protective covering. Some sensors may not be able to operate when the protective covering is metallic and, consequently, may be made from a nonmetallic material (e.g., a composite). Due to the harsh subterranean environments, even these protective coverings may fail, and the sensors can become inoperable. In addition, as the sensors may be made from various materials, such as rubber, plastics, and metals, that may have different thermal expansion characteristics, the sensors may be also be damaged as the materials expand or contract with changes in temperature. Replacing sensors or related components like protective coverings can delay the wellbore operation and increase maintenance costs. Examples of environmental compensation systems that have been used to compensate for conditions encountered in subterranean environments may include piston-based systems and systems with tubular elastomers disposed along a shaft. However, both of those examples often require significant space to reside within the LWD/MWD tools. In addition, the benefits of these systems may be limited as they are typically configured to operate in a single direction.

BRIEF DESCRIPTION OF THE DRAWINGS

These drawings illustrate certain aspects of some examples of the present disclosure, and should not be used to limit or define the disclosure.

DETAILED DESCRIPTION

This disclosure may generally relate to wellbore operations. More particularly, embodiments may relate to systems and methods to compensate for changes in environmental conditions, such as temperature and pressure, that may be experienced by downhole tools. Systems and methods may employ a bladder in the downhole tool, for example, that can adjust the pressure differential between the interior of the downhole tool and the external environment to a mechanically tolerable level so as to reduce the number of sensor and covering failures. The bladder may also serve as a reservoir for expanding fluid, for example, to compensate for the volume displacement encountered with thermal expansion.

Figure 1:
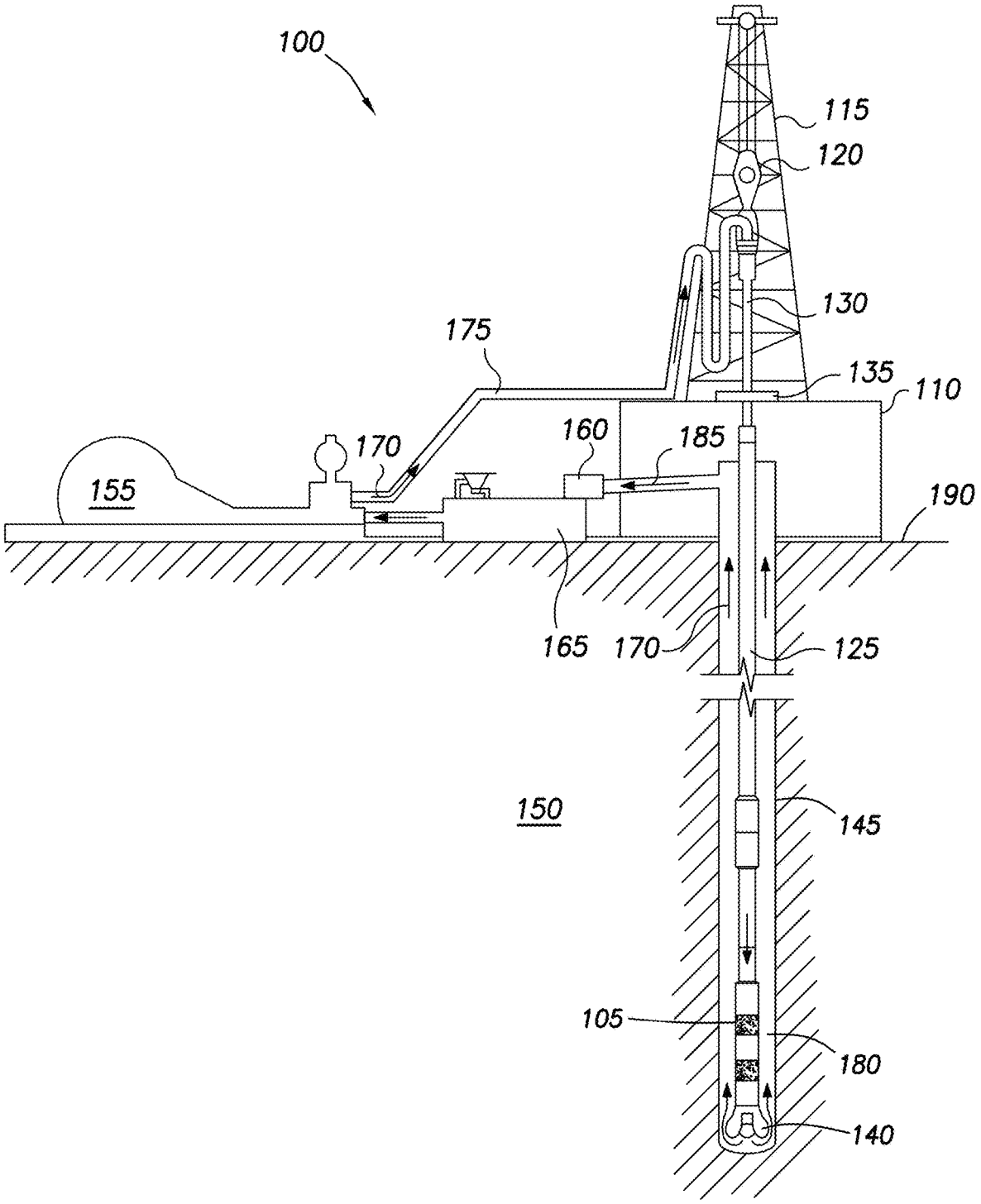
FIG. 1 illustrates an embodiment of a downhole system.

FIG. 1 illustrates a downhole system 100 that includes a downhole tool 105. While FIG. 1 illustrates use of downhole tool 105 in a drilling process, embodiments disclosed herein should not be limited to drilling, but instead downhole tool 105 may be used in any suitable subterranean operation in which compensation for environmental changes, such as pressure and temperature, may be desired. Downhole system 100 may include a drilling platform 110 that supports a derrick 115 having a traveling block 120 for raising and lowering a conveyance line 125. Conveyance line 125 may include any suitable means for providing mechanical conveyance for downhole tool 105, including, but not limited to, wireline, slickline, coiled tubing, pipe, drill pipe, or the like. In some examples, conveyance line 125 may provide mechanical suspension, as well as electrical connectivity, for downhole tool 105. A kelly 130 may support conveyance line 125 as conveyance line 125 may be lowered through a rotary table 135. A drill bit 140 may be attached to the distal end of conveyance line 125 and may be driven either by a downhole motor (not shown) and/or via rotation of conveyance line 125. Without limitation, drill bit 140 may include any suitable type of drill bit 140, including, but not limited to, roller cone bits, PDC bits, natural diamond bits, any hole openers, reamers, coring bits, and the like. As drill bit 140 rotates, drill bit 140 may create a wellbore 145 that penetrates various subterranean formations 150.

Downhole system 100 may further include a mud pump 155, one or more solids control systems 160, and a retention pit 165. Mud pump 155 representatively may include any conduits, pipelines, trucks, tubulars, and/or pipes used to fluidically convey drilling fluid 170 downhole, any pumps, compressors, or motors (e.g., topside or downhole) used to drive the drilling fluid 170 into motion, any valves or related joints used to regulate the pressure or flow rate of drilling fluid 170, any sensors (e.g., pressure, temperature, flow rate, etc.), gauges, and/or combinations thereof, and the like.

Mud pump 155 may circulate drilling fluid 170 through a feed conduit 175 and to kelly 130, which may convey drilling fluid 170 downhole through the interior of conveyance line 125 and through one or more orifices (not shown) in drill bit 140. Drilling fluid 170 may then be circulated back to surface 190 via a wellbore annulus 180 defined between conveyance line 125 and the walls of wellbore 145. At surface 190, the recirculated or spent drilling fluid 170 may exit wellbore annulus 180 and may be conveyed to one or more solids control system 160 via an interconnecting flow line 185. One or more solids control systems 160 may include, but are not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, and/or any fluid reclamation equipment. The one or more solids control systems 160 may further include one or more sensors, gauges, pumps, compressors, and the like used store, monitor, regulate, and/or recondition the drilling fluid 170.

After passing through the one or more solids control systems 160, drilling fluid 170 may be deposited into a retention pit 165 (e.g., a mud pit). While illustrated as being arranged at the outlet of wellbore 145 via wellbore annulus 180, those skilled in the art will readily appreciate that the one or more solids controls system 160 may be arranged at any other location in downhole system 100 to facilitate its proper function, without departing from the scope of the disclosure. While FIG. 1 shows only a single retention pit 165, there could be more than one retention pit 165, such as multiple retention pits 165 in series. Moreover, the retention pit 165 may be representative of one or more fluid storage facilities and/or units where the drilling fluid additives may be stored, reconditioned, and/or regulated until added to the drilling fluid 170. It should be noted that while FIG. 1 generally depicts a land-based downhole system, those skilled in the art will readily recognize that the principles describe herein are equally applicable to subsea drilling operations that employ floating or sea-based platforms and rigs, without departing from the scope of the disclosure.

Throughout the drilling process, measurements may be taken in order to gather data concerning the subterranean formations 150 made while drilling. Tools housing one or more sensors may be disposed within conveyance line 125 to gather this data. As illustrated, a downhole tool 105 may be employed in downhole system 100. Without limitation, downhole tool 105 may include a logging-while-drilling (LWD) tool or a measurement-while-drilling (MWD) tool. An LWD tool may be any conventional logging instrument, including, but not limited to, instruments based on acoustic (sometimes referred to as sonic), neutron, gamma ray, density, photoelectric, nuclear magnetic resonance, or any other conventional logging technique, or combinations thereof, which can be used to measure subterranean formations 150 surrounding wellbore 145. The logging data may be stored in a conventional downhole recorder (not shown), which can be accessed at surface 190 when conveyance line 125 is retrieved, or can be transmitted to surface 190 using telemetry such as the conventional mud pulse telemetry systems. In addition, wireline logging instrumentation may also be used. The wireline instrumentation may include, but is not limited to, any conventional logging instrumentation which can be used to measure the lithology and/or porosity of subterranean formations 150 surrounding wellbore 145, for example, instruments based on as acoustic, neutron, gamma ray, density, photoelectric, nuclear magnetic resonance, or any other conventional logging technique, or combinations thereof, which can be used to measure lithology.

Downhole tool 105 may include one or more sensors (e.g., sensor 625 on FIG. 6) to collect the data concerning subterranean formations 150 around wellbore 145 as drill bit 140 operates. Downhole tool 105 may also include protective coverings (e.g., first protective sleeve 310 and second protective sleeve 315 shown on FIG. 3A), wherein the protective coverings may be disposed around downhole tool 105. Protective coverings may be made from any suitable material. Suitable material may include metals, plastic, rubber, neoprene, composites or any combination thereof. Some sensors may not be able to operate when located near a specific material (e.g., metals). For those applications, protective coverings made from nonmetallic or composite materials may be utilized. As drilling fluid 170 circulates back to surface 190 via wellbore annulus 180, a large amount of pressure may be applied to the outside of the downhole tool 102, including the protective coverings (e.g., first protective sleeve 310 and second protective sleeve 315 shown on FIG. 3A). Due to the material selection, these protective coverings may fail due to the overbearing mechanical strain, rendering the one or more sensors within inoperable.

Figure 2:
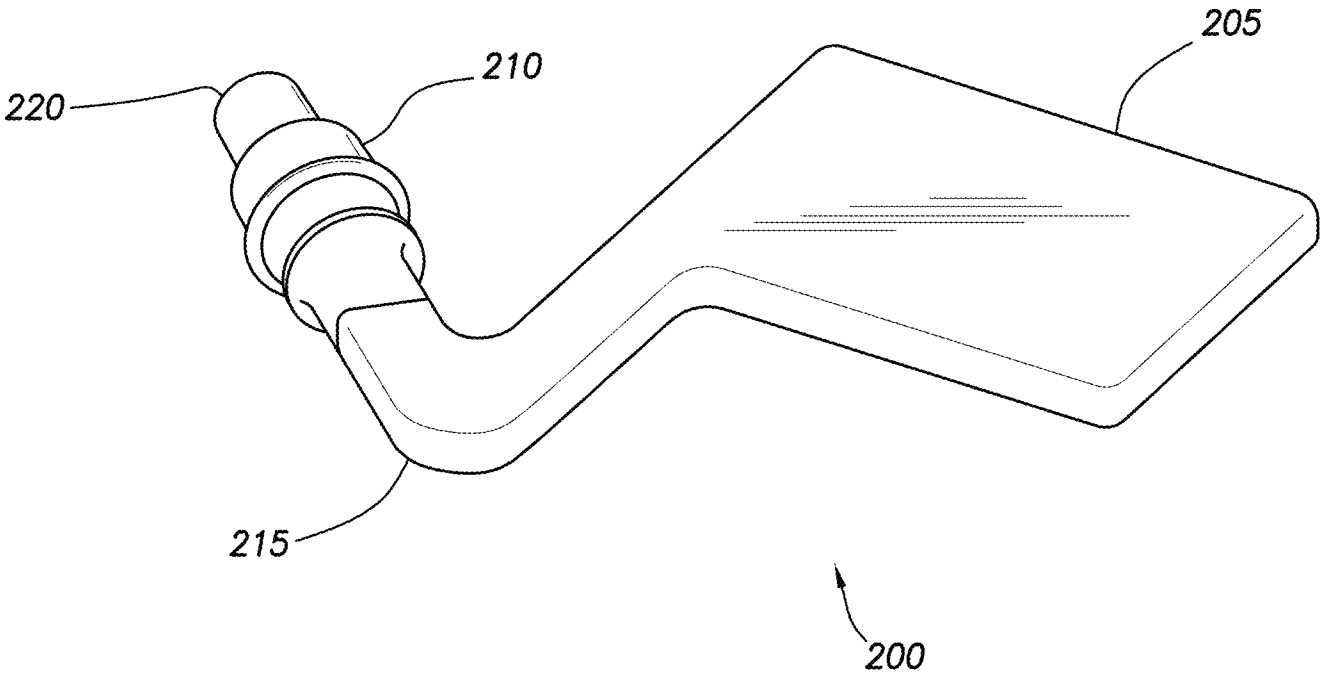
FIG. 2 illustrates an embodiment of an environmental compensation system.

FIG. 2 illustrates an environmental compensation system 200 that may be used with downhole tool 105 (e.g., shown on FIG. 1). Environmental compensation system 200 may increase the reliability of the protective coverings (e.g., first protective sleeve 310 and second protective sleeve 315 shown on FIG. 3A) by equalizing the internal and external pressure experienced by the protective coverings, thereby reducing the stresses applied. As illustrated, environmental compensation system 200 may include a bladder 205 and a rigid stem 210.

Bladder 205 may serve to depress and expand when pressure is applied (e.g., from drilling fluid 170 on FIG. 1). Bladder 205 may contain a fluid. Any suitable fluid may be used, including fluids that are incompressible. Suitable fluids may include, but are not limited to, silicone oil, hydraulic fluid, and organic based oils. Bladder 205 may be made from any suitable material. Suitable materials may include materials that are flexible and compliant. Suitable materials may include, but are not limited to, plastics, rubbers, polymers and/or combinations thereof. Bladder 205 may be any suitable shape. Without limitation, a suitable shape may include, but are not limited to, cross-sectional shapes that are circular, elliptical, triangular, rectangular, square, hexagonal, and/or combinations thereof. Bladder 205 may have rigid stem 210 affixed thereto. As illustrated, arm 215 may extend from bladder 205, wherein arm 215 interconnects rigid stem 210 and bladder 205.

Rigid stem 210 may serve as a connection between the interior of bladder 205 and the environment external to bladder 205. As illustrated, rigid stem 210 may include an exit port 220. Exit port 220 may allow fluid to exit bladder 205 when pressure is applied to bladder 205. Exit port 220 may also allow equalization of pressure within bladder 205 with the environment in fluid communication with the interior of bladder 205 by way of rigid stem 210. Exit port 220 may also allow fluid to enter bladder 205 by way of rigid stem 210. Rigid stem 210 may be any suitable shape. Without limitation, a suitable shape may include, but is not limited to, a cross-sectional shape that is circular, elliptical, triangular, rectangular, square, hexagonal, and/or combinations thereof. Rigid stem 210 may be made from any suitable material that is stiff. Suitable materials may include, but are not limited to, metals, nonmetals, polymers, ceramics and/or combinations thereof. Rigid stem 210 may be affixed to an end of bladder 205, for example, to arm 215, using any suitable mechanism, including, but not limited, through the use of suitable fasteners, threading, adhesives, welding and/or any combination thereof. Without limitation, suitable fasteners may include nuts and bolts, washers, screws, pins, sockets, rods and studs, hinges and/or any combination thereof.

Figure 3B:
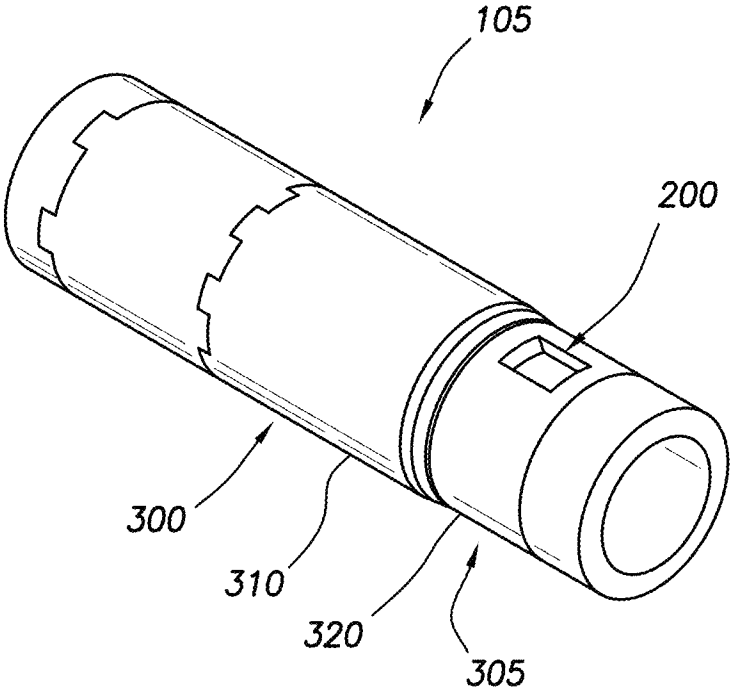
FIG. 3B illustrates the embodiment of FIG. 3A with one of the protective coverings removed.
Figure 3A:
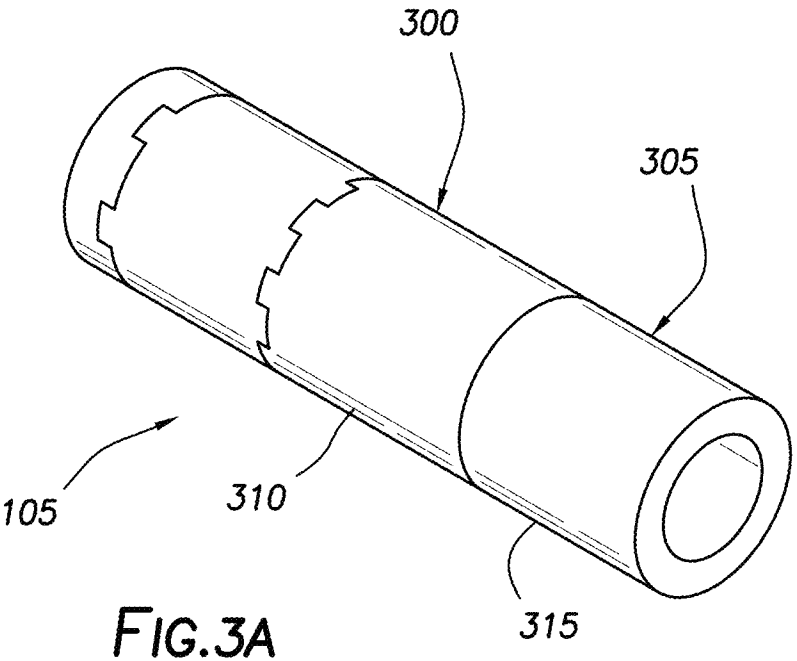
FIG. 3A illustrates an embodiment of a downhole tool with different protective coverings.

FIGS. 3A and 3B illustrate downhole tool 105 in which environmental compensation system 200 may be disposed. FIG. 3A illustrates downhole tool 105 with different protective coverings, shown as first protective sleeve 310 and second protective sleeve 315. FIG. 3B illustrates downhole tool 105 with one of the protective coverings (e.g., second protective sleeve 315) removed to show environmental compensation system 200. As illustrated, downhole tool 105 may include a first section 300 and a second section 305. First section 300 may include a protective covering in the form of first protective sleeve 310, and second section 305 may include a protective covering in the form of second protective sleeve 315. First protective sleeve 310 may be sealed to insulate the interior of first section 300 from the exterior environment while second protective sleeve 315 may be unsealed to expose the interior of second section 305 to the exterior environment. First protective sleeve 310 may be designed to cover a sensor (e.g., sensor 625 on FIG. 6) while second protective sleeve 315 may be designed to cover environmental compensation system 200. As best seen on FIG. 3B, environmental compensation system 200 may be disposed in tool body 320.

First protective sleeve 310 and second protective sleeve 315 may be any suitable shape as will be appreciated by those of ordinary skill in the art. Without limitation, a suitable shape may include a cross-sectional shape that is circular, elliptical, triangular, rectangular, square, hexagonal, and/or combinations thereof. As illustrated, first protective sleeve 310 and second protective sleeve 315 may be cylindrical in shape with a circular cross section. First protective sleeve 310 and second protective sleeve 315 may be made from any suitable material. Suitable materials may include metals, nonmetals, polymers, ceramics and/or combinations thereof. In embodiments, first protective sleeve 310 may be non-metallic while second protective sleeve 315 may be non-metallic. In embodiments, first protective sleeve 310 and/or second protective sleeve 315 may be made from a composite material that includes metal. In some examples, first protective sleeve 310 may be made from a non-metallic material, for example, to avoid interference with sensor (e.g., sensor 625 on FIG. 6) that may be disposed under first protective sleeve 310 in first section 300. However, because first protective sleeve 310 may be made from a non-metallic material, it may be more susceptible to failure from pressure differentials that may be experienced during use. Alternatively, first protective sleeve 310 may made from a metallic material, but thinner than conventionally used to improve signal to noise ratio for the underlying sensor. Even though made from metallic material, first protective sleeve 310 may also be more susceptible to failure if first protective sleeve 310 is thinner than conventionally used. Accordingly, environmental compensation system 200 may be used to equalize pressure under the first protective sleeve 310 with pressure external to first protective sleeve 310, thus reducing negative impacts from downhole use.

Figure 4:
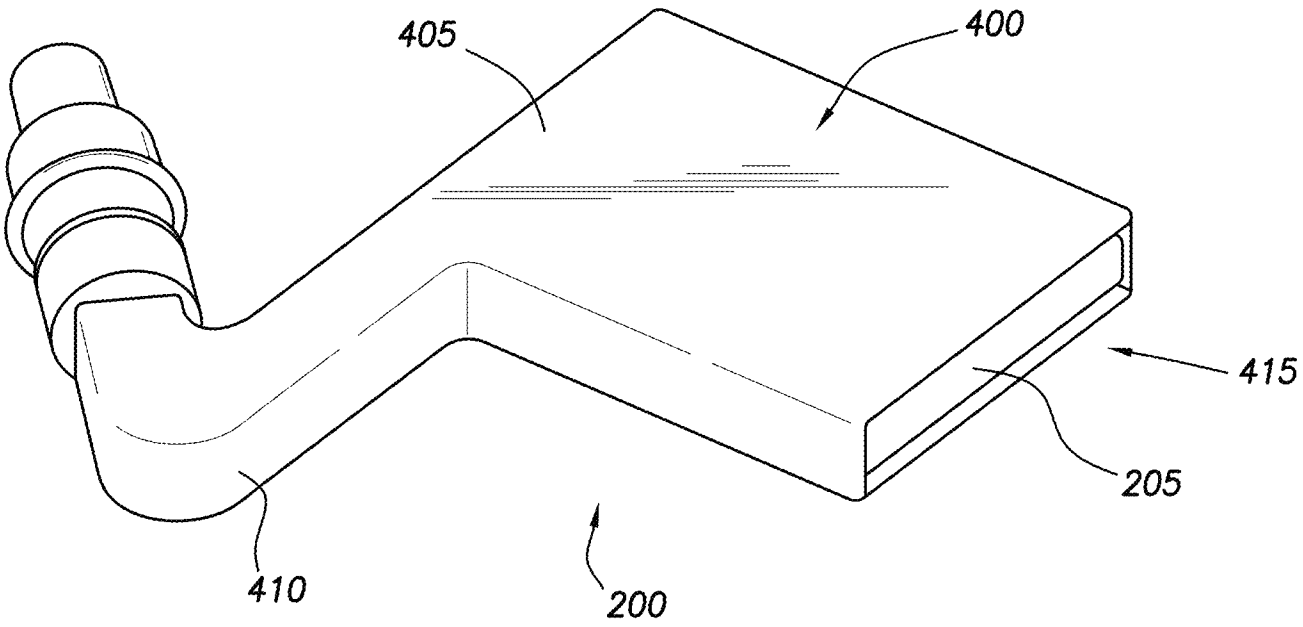
FIG. 4 illustrates another embodiment of an environmental compensation system.

FIG. 4 illustrates another example of environmental compensation system 200 that further includes case 400. Case 400 may be implemented in environmental compensation system 200 in order to protect bladder 205, since bladder 205 may be made of a flexible, compliant material. Case 400 may be disposed around bladder 205, wherein bladder 205 may be installed in case 400. In embodiments, case 400 may be utilized for easier field replacement techniques when concern for damaging bladder 205 may be present. Case 400 may be any suitable shape that accommodates bladder 205. Without limitation, suitable shapes may include cross-sectional shapes that are circular, elliptical, triangular, rectangular, square, hexagonal, and/or combinations thereof. As illustrated, case 400 may include a rectangular box 405 with an arm extension 410. In embodiments, the shape of case 400 matches that of the shape of bladder 205. Case 400 may be manufactured from any suitable material. Without limitation, case 400 may be manufactured from a material is able to tolerate a high load. Suitable materials may include metals, nonmetals, polymers, ceramics and/or combinations thereof. Specific examples of suitable materials for case 400 may include, but are not limited to, an austenic nickel-chromium superalloy, polyether ether ketone, and/or fiberglass composite. Case 400 may include one or more openings so that bladder 205 may be exposed to the environment external to case 400. As illustrated, case 400 may include an open end 415. While case 400 is shown with only a single open end 415, case 400 may be constructed to include multiple openings for exposure of bladder 205 to the external environment. While open end 415 is shown at one end of case 400, it should be understood that the one or more openings may be disposed anywhere along case 400. Open end 415 may be any suitable shape. Without limitation, a suitable shape may be circular, elliptical, triangular, rectangular, square, hexagonal, and/or combinations thereof. Open end 415 may serve to allow an external environment, such as drilling fluid 170, to apply pressure to bladder 205 in order for an interior of bladder 205 to increase in pressure. For example, bladder 205 may depress and expand within case 400 as the pressure increases. In embodiments with an incompressible fluid disposed in bladder 205, bladder 205 may not depress, but instead may transfer external pressure applied to bladder 205 to the fluid disposed in bladder 205 such that the fluid inside bladder 205 also increases in pressure.

Figure 5:
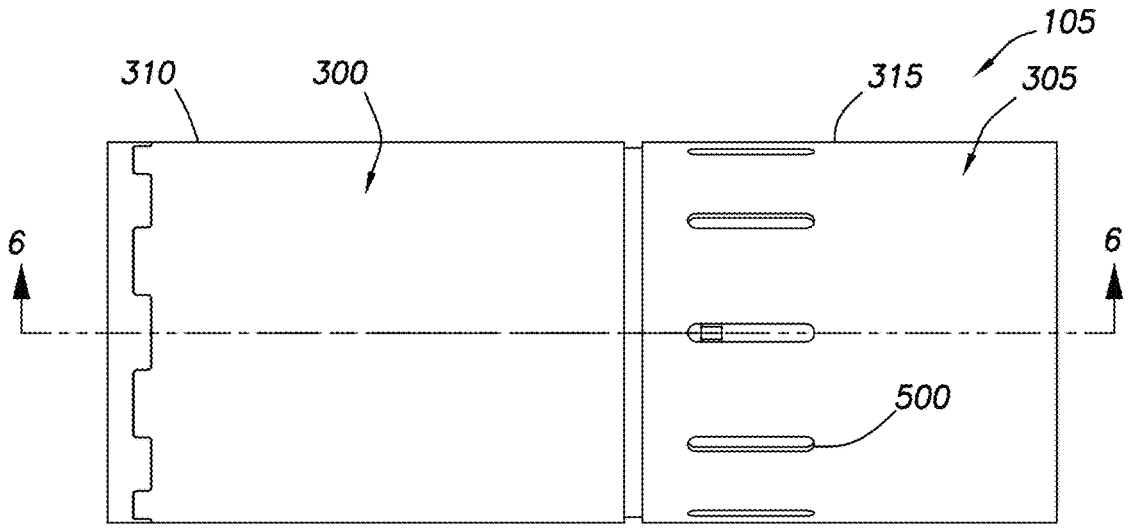
FIG. 5 illustrates another embodiment of a downhole tool with different protective coverings.
Figure 6:
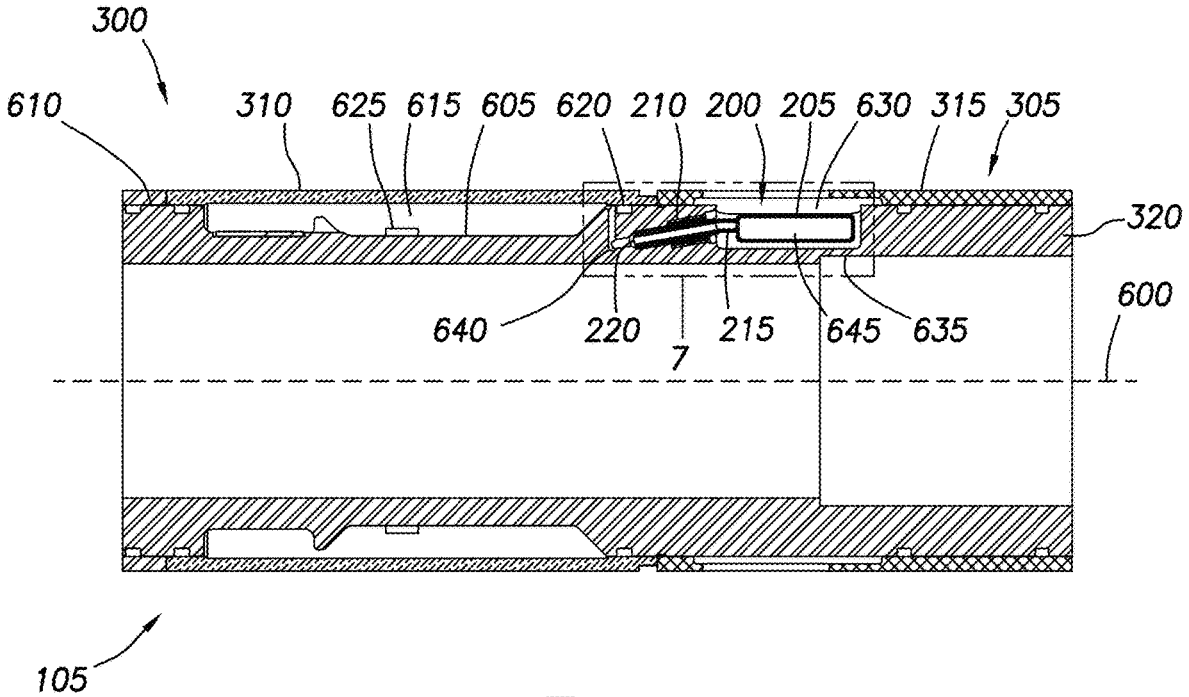
FIG. 6 illustrates a cross-sectional view taken along line 6-6 of the embodiment of FIG. 5.
Figure 7:
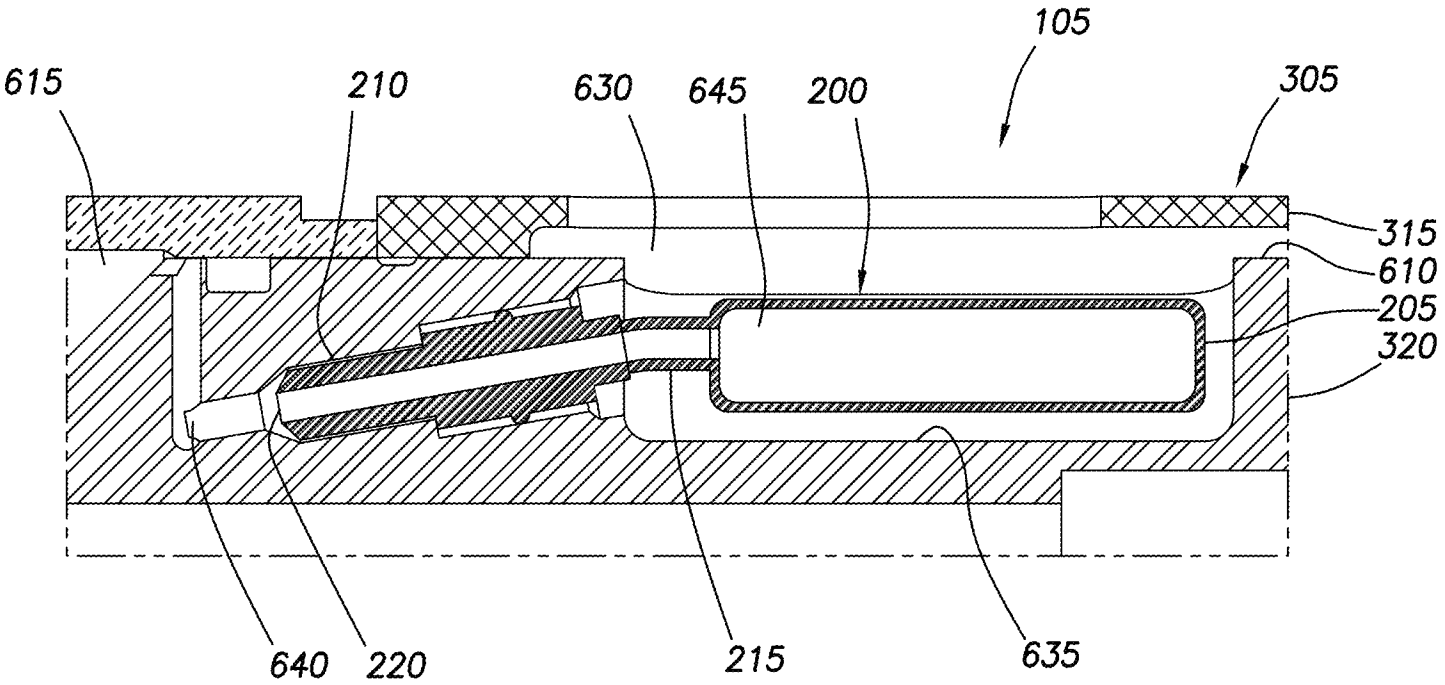
FIG. 7 illustrates a close-up view taken along box 7 of the embodiment of FIG. 6.

FIGS. 5-7 illustrate implementation of environmental compensation system 200 in downhole tool 105. FIG. 5 illustrates a portion of downhole tool 105 that includes a first protective sleeve 310 and a second protective sleeve 315. FIG. 6 is a cross-sectional view of FIG. 5 taken along line 6-6. FIG. 7 is an enlarged view of FIG. 5 taken along box 7.

With reference now to FIG. 5, a portion of downhole tool 105 is shown that includes a first section 300 and a second section 305. First section 300 and second section 305 may be adjacent to one another as shown on FIG. 5 or may be spaced by one or more intervening sections (now shown). First section 300 may include a protective covering in the form of first protective sleeve 310. Second section 305 may include a protective covering in the form of second protective sleeve 315. As illustrated, one or more holes 500 may be formed in second protective sleeve 315. One or more holes 500 may be disposed anywhere along second protective sleeve 315. As illustrated, one or more holes 500 may be spaced around the circumference of second protective sleeve 315. One or more holes 500 may be any suitable shape. Without limitation, a suitable shape for one or more holes 500 may be circular, elliptical, triangular, rectangular, square, hexagonal, and/or combinations thereof. One or more holes 500 may be an absence of material in second protective sleeve 315. One or more holes 500 may also expose bladder 205 (e.g., FIGS. 2, 4, 6, 7) to the environment external to second protective sleeve 315, for example, by allowing drilling fluid 170 (e.g., FIG. 1) to pass through second protective sleeve 315 to apply pressure to bladder 205.

FIG. 6 illustrates an embodiment of a cross-sectional view of the downhole tool 105 of FIG. 5 taken along line 6-6. As illustrated, downhole tool 105 may include first section 300, second section 305, and tool body 320. By way of example, tool body 320 may be tubular in shape and extend through first section 300 and second section 305 along tool longitudinal axis 600. As illustrated, tool body 320 may include a cutout 605 in exterior surface 610. Cutout 605 may form an annulus 615 between first protective sleeve 310 and tool body 320. As illustrated, annulus 615 may be the empty space between first protective sleeve 310 and tool body 320. In embodiments, the first protective sleeve 310 may be sealed so that annulus 615 may not be exposed to the environment external to downhole tool 105. For example, sealing first protective sleeve 310 may prevent drilling fluid 170 (e.g., FIG. 1) d from entering into first section 300. Any suitable technique may be used to seal first protective sleeve 310, including, but not limited to, mechanical seals 620. Annulus 615 may contain a fluid. Non-limiting examples of fluids that may be contained in annulus 615, may include, but are not limited to, incompressible fluids, such as silicone oil, hydraulic fluid, or organic based oils.

As illustrated, first section 300 of downhole tool 105 may also include a sensor 625. In the illustrated embodiment sensor 625 may be disposed on, or in, tool body 320. Any suitable sensor 625 may be used, including, but not limited to, antenna windings, toroids, Hall Effect sensors, and/or piezoelectric sensors. Since sensor 625 within first section 300 of downhole tool 105 may be negatively impacted by metallic materials, first protective sleeve 310 may be made from nonmetallic and/or composite materials. When drilling fluid 170 (e.g., shown on FIG. 1) circulates past first protective sleeve 310, or when downhole temperature increases from the original ambient, large pressure differentials may be created between the outside and inside of first protective sleeve 310. Therefore, environmental compensation system 200 may use the fluid within annulus 615 to alleviate at least a portion of the pressure differential in multiple directions. In addition, temperature change experienced during downhole use may cause expansion or contraction of materials. As described, embodiments of environmental compensation system 200 may also accommodate these thermal-induced changes.

With reference to FIGS. 6 and 7, downhole tool 105 may include environmental compensation system 200. While only a single environmental compensation 200 is shown, there may be a plurality of environmental compensation systems 200 used with downhole tool 105. Environmental compensation system 200 may be at least partially disposed in second section 305 of downhole tool 105. However, environmental compensation system 200 may be located in other positions in downhole tool 105 so long as environmental compensation system 200 may be pressures external to downhole tool 105. Environmental compensation system 200 may include bladder 205, arm 215 that extends from bladder 205, rigid stem 210, and exit port 220. Bladder 205 may be disposed in second section 305. As illustrated, bladder 205 may be disposed in tool body 320. For example, bladder 205 may be disposed in opening 630 formed between exterior surface 610 of tool body 320 and second protective sleeve 315. While second protective sleeve 315 is shown, bladder 205 does not necessarily need to be covered by second protective sleeve 315 and instead, other suitable parts, such as a stabilizer, may protect bladder 205. A recess 635 may be formed in tool body 320 to enlarge opening 630, wherein bladder 205 may be disposed in recess 635. While not shown on FIGS. 6 and 7, case 400 may be used to protect bladder 205, as described above with respect to FIG. 4. With reference again to FIGS. 6 and 7, arm 215 may extend from bladder 205. As illustrated, arm 215 may extend from bladder 205 into pathway 640. As illustrated, pathway 640 may be formed in tool body 320 and may interconnect annulus 615 and opening 630. Rigid stem 210 may be disposed in pathway 710. A seal may be formed in pathway 640 to seal opening 630 in second section 305 from annulus 615 in first section 300. Pathway 640 may be any suitable size and shape for accepting arm 215.

Example operation of environmental compensation system 200 will now be described with respect to FIGS. 1, 6, and 7. As shown on FIG. 1, downhole tool 105 may be disposed in wellbore 145. Because second section 305 may be unsealed, bladder 205 in second section 305 should experience the same downhole pressures experienced by first protective sleeve 310. Accordingly, as pressures external to downhole tool 105 increase, the pressure applied to bladder 205 should also increase, resulting in an increase in pressure in interior 645 of bladder 205. As exit port 220 is open and in fluid communication with annulus 615 increases in pressure in interior 645 of bladder 205 should result in an equivalent pressure increase in annulus 615. In this manner, pressure in annulus 615 in which sensor 625 may be disposed may be equalized with external pressures to downhole tool 105 that may be experienced in wellbore 145. By equalizing pressure, stress may be reduced on first protective sleeve 310, leading to an increase in reliability, among other benefits. Additionally, as downhole tool 105 may be disposed into wellbore 145, the ambient temperature may also increase. Fluid underneath first protective sleeve 310 in annulus 615 and underneath second protective sleeve 315 in opening 630 may expand due to the increase in temperature. In embodiments, some sensors, such as sensor 625, may expand or contract as well, depending on the coefficients of thermal expansion for materials from which sensor 625 may be constructed. Bladder 205 may serve as a reservoir for the expanding fluid from annulus 615. As fluid may expand into bladder 205 from annulus 615 by way of pathway 640. In this manner, environmental compensation system 200 may serve to compensate for the volume displacement encountered with thermal expansion.

The systems and methods to compensate for changes in environmental conditions may include any of the various features of the systems and methods disclosed herein, including one or more of the following statements.

Statement 1. A downhole tool comprising: a tool body; a protective sleeve disposed around the tool body, wherein an annulus is formed between the protective sleeve and the tool body; a sensor coupled to the tool body; and an environmental compensation system comprising a bladder having an interior in fluid communication with the annulus.

Statement 2. The downhole tool of statement 1, wherein the interior of the bladder contains an incompressible fluid.

Statement 3. The downhole tool of statement 1 or 2, wherein the interior of the bladder contains silicone oil.

Statement 4. The downhole tool of any preceding statement, wherein the bladder is disposed in a recess formed in the tool body, the bladder being exposed to an environment external to the downhole tool.

Statement 5. The downhole tool of any preceding statement, wherein the environmental compensation system further comprises an arm extending from the bladder and into a pathway in the tool body, wherein the pathway interconnects the recess and the annulus.

Statement 6. The downhole tool of any preceding statement, wherein the environmental compensation system further comprises a rigid stem disposed on the arm in the pathway.

Statement 7. The downhole tool of any preceding statement, wherein the environmental compensation system further comprises a case that houses the bladder.

Statement 8. The downhole tool of any preceding statement, further comprising an additional protective sleeve disposed around the tool body, wherein the bladder is disposed in an opening formed between an exterior surface of the tool body and the additional protective sleeve, and wherein one or more holes are formed in the additional protective sleeve to expose the bladder to an environment external to the downhole tool.

Statement 9. The downhole tool of any preceding statement, wherein the bladder is disposed in a recess formed in the tool body, wherein the environmental compensation system further comprises an arm that extends from the bladder, a rigid stem coupled to the bladder by the arm, and an exit port disposed on rigid stem, wherein the interior of the bladder is in fluid communication with the annulus by way of the exit port, wherein the arm extends into a pathway in the tool body that interconnects the recess and the annulus, wherein the bladder is configured such that pressure increases on the bladder results in a pressure increase in the annulus, and wherein the bladder is configured such that the bladder is a reservoir for expanding fluids in the annulus to compensate for thermal expansion in the annulus Statement 10. A downhole system, the downhole system comprising: a conveyance line; and a downhole tool attached to the conveyance line, wherein the downhole tool comprises: a tool body; a protective sleeve disposed around the tool body, wherein an annulus is formed between the protective sleeve and the tool body; a sensor coupled to the tool body; and an environmental compensation system comprising a bladder having an interior in fluid communication with the annulus.

Statement 11. The downhole system of statement 10, wherein the interior of the bladder contains an incompressible fluid.

Statement 12. The downhole system of statement 10 or 11, wherein the bladder is disposed in a recess formed in the tool body, the bladder being exposed to an environment external to the downhole tool.

Statement 13. The downhole system of any of statements 10 to 12, wherein the environmental compensation system further comprises an arm extending from the bladder and into a pathway in the tool body, wherein the pathway interconnects the recess and the annulus.

Statement 14. The downhole system of any of statements 10 to 13, wherein the environmental compensation system further comprises a case that houses the bladder.

Statement 15. The downhole system of any of statements 10 to 14, wherein the downhole tool further comprises an additional protective sleeve disposed around the tool body, wherein the bladder is disposed in an opening formed between an exterior surface of the tool body and the additional protective sleeve, and wherein one or more holes are formed in the additional protective sleeve to expose the bladder to an environment external to the downhole tool.

Statement 16. The downhole system of any of statements 10 to 15, wherein the bladder is disposed in a recess formed in the tool body, wherein the environmental compensation system further comprises an arm that extends from the bladder, a rigid stem coupled to the bladder by the arm, and an exit port disposed on rigid stem, wherein the interior of the bladder is in fluid communication with the annulus by way of the exit port, wherein the arm extends into a pathway in the tool body that interconnects the recess and the annulus, wherein the bladder is configured such that pressure increases on the bladder results in a pressure increase in the annulus, and wherein the bladder is configured such that the bladder is a reservoir for expanding fluids in the annulus to compensate for thermal expansion in the annulus.

Statement 17: The downhole system of any one of statements 10 to 16, wherein the conveyance line comprises a drill string, and wherein the downhole system further comprises a drill bit attached at a distal end of the drill string.

Statement 18. A method for pressure and thermal expansion compensation, the method comprising: placing a downhole tool into a wellbore; and exposing a bladder disposed in the downhole tool to downhole pressure in the wellbore, wherein an interior of the bladder is in fluid communication with an annulus, wherein the annulus is formed between a tool body of the downhole tool and a protective sleeve disposed around the tool body, wherein an increase in the downhole pressure results in an increase in pressure in the annulus due to an increase in pressure exerted on the bladder such that a pressure differential experienced by the protective sleeve is reduced.

Statement 19. The method of statement 18, flowing drilling fluid over the protective sleeve such that temperatures in the downhole tool increase causing expansion of fluid in the annulus, wherein the bladder is a reservoir for the fluid in the annulus as it expands.

Statement 20. The method of statement 18 or 19, wherein the bladder is exposed to the downhole pressure through one or more holes in an additional protective sleeve disposed around the tool body, and wherein the interior of the bladder is in fluid communication with the annulus through a pathway in the tool body.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole tool comprising:

a tool body;

a protective sleeve disposed around the tool body, wherein an annulus is formed between the protective sleeve and the tool body;

a sensor coupled to the tool body; and an environmental compensation system comprising a bladder having an interior in fluid communication with the annulus, wherein the bladder is disposed in a recess formed in the tool body, the bladder being exposed to an environment external to the downhole tool, wherein a pathway in the tool body interconnects the recess and the annulus, and wherein a portion of the environmental compensation system extends into the pathway.

2. The downhole tool of claim 1, wherein the interior of the bladder contains an incompressible fluid.

3. The downhole tool of claim 1, wherein the interior of the bladder contains silicone oil.

4. The downhole tool of claim 1, wherein the environmental compensation system further comprises an arm extending from the bladder and into the pathway in the tool body.

5. The downhole tool of claim 4, wherein the environmental compensation system further comprises a rigid stem disposed on the arm in the pathway.

6. The downhole tool of claim 1, wherein the environmental compensation system further comprises a case that houses the bladder.

7. The downhole tool of claim 1, further comprising an additional protective sleeve disposed around the tool body, wherein the bladder is disposed in an opening formed between an exterior surface of the tool body and the additional protective sleeve, and wherein one or more holes are formed in the additional protective sleeve to expose the bladder to an environment external to the downhole tool.

8. The downhole tool of claim 1, wherein the bladder is disposed in a recess formed in the tool body, wherein the environmental compensation system further comprises an arm that extends from the bladder, a rigid stem coupled to the bladder by the arm, and an exit port disposed on rigid stem, wherein the interior of the bladder is in fluid communication with the annulus by way of the exit port, wherein the arm extends into a pathway in the tool body that interconnects the recess and the annulus, wherein the bladder is configured such that pressure increases on the bladder results in a pressure increase in the annulus, and wherein the bladder is configured such that the bladder is a reservoir for expanding fluids in the annulus to compensate for thermal expansion in the annulus.

9. A downhole system, comprising:

a conveyance line; and a downhole tool attached to the conveyance line, wherein the downhole tool comprises:

a tool body;

a protective sleeve disposed around the tool body, wherein an annulus is formed between the protective sleeve and the tool body;

a sensor coupled to the tool body; and an environmental compensation system comprising a bladder having an interior in fluid communication with the annulus, wherein the bladder is disposed in a recess formed in the tool body, the bladder being exposed to an environment external to the downhole tool, wherein a pathway in the tool body interconnects the recess and the annulus, and wherein a portion of the environmental compensation system extends into the pathway.

10. The downhole system of claim 9, wherein the interior of the bladder contains an incompressible fluid.

11. The downhole system of claim 9, wherein the environmental compensation system further comprises an arm extending from the bladder and into the pathway in the tool body.

12. The downhole system of claim 9, wherein the environmental compensation system further comprises a case that houses the bladder.

13. The downhole system of claim 9, wherein the downhole tool further comprises an additional protective sleeve disposed around the tool body, wherein the bladder is disposed in an opening formed between an exterior surface of the tool body and the additional protective sleeve, and wherein one or more holes are formed in the additional protective sleeve to expose the bladder to an environment external to the downhole tool.

14. The downhole system of claim 9, wherein the bladder is disposed in a recess formed in the tool body, wherein the environmental compensation system further comprises an arm that extends from the bladder, a rigid stem coupled to the bladder by the arm, and an exit port disposed on rigid stem, wherein the interior of the bladder is in fluid communication with the annulus by way of the exit port, wherein the arm extends into a pathway in the tool body that interconnects the recess and the annulus, wherein the bladder is configured such that pressure increases on the bladder results in a pressure increase in the annulus, and wherein the bladder is configured such that the bladder is a reservoir for expanding fluids in the annulus to compensate for thermal expansion in the annulus.

15. The downhole system of claim 9, wherein the conveyance line comprises a drill string, and wherein the downhole system further comprises a drill bit attached at a distal end of the drill string.

16. A method for pressure and thermal expansion compensation, comprising:

placing a downhole tool into a wellbore; and exposing a bladder disposed in the downhole tool to downhole pressure in the wellbore, wherein an interior of the bladder is in fluid communication with an annulus through a pathway in the tool body, wherein the annulus is formed between a tool body of the downhole tool and a protective sleeve disposed around the tool body, wherein an increase in the downhole pressure results in an increase in pressure in the annulus due to an increase in pressure exerted on the bladder such that a pressure differential experienced by the protective sleeve is reduced, and wherein the bladder is exposed to the downhole pressure through one or more holes in an additional protective sleeve disposed around the tool body.

17. The method of claim 16, further comprising flowing drilling fluid over the protective sleeve such that temperatures in the downhole tool increase causing expansion of fluid in the annulus, wherein the bladder is a reservoir for the fluid in the annulus as it expands.

* * * * *